US008528636B2

(12) United States Patent
Brooks

(10) Patent No.: US 8,528,636 B2
(45) Date of Patent: Sep. 10, 2013

(54) INSTANTANEOUS MEASUREMENT OF DRILLSTRING ORIENTATION

(75) Inventor: Andrew G. Brooks, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 594 days.

(21) Appl. No.: 11/854,409

(22) Filed: Sep. 12, 2007

(65) Prior Publication Data

US 2008/0230273 A1 Sep. 25, 2008

Related U.S. Application Data

(60) Provisional application No. 60/844,185, filed on Sep. 13, 2006.

(51) Int. Cl.
*E21B 47/09* (2012.01)

(52) U.S. Cl.
USPC ..... 166/255.1; 166/255.2; 166/255.3; 175/45

(58) Field of Classification Search
USPC ..... 166/255.1, 255.2, 255.3; 175/45; 73/152.54; 33/304, 313
See application file for complete search history.

(56) References Cited

U.S. PATENT DOCUMENTS

| | | | | |
|---|---|---|---|---|
| 3,805,398 | A * | 4/1974 | Russell et al. | 33/312 |
| 4,813,274 | A | 3/1989 | DiPersio et al. | |
| 5,012,412 | A | 4/1991 | Helm | |
| 6,173,773 | B1 * | 1/2001 | Almaguer et al. | 166/255.2 |
| 7,195,062 | B2 * | 3/2007 | Cairns et al. | 166/255.2 |
| 7,234,540 | B2 * | 6/2007 | Estes et al. | 175/45 |
| 2002/0050930 | A1 * | 5/2002 | Thomeer et al. | 340/853.3 |
| 2004/0016571 | A1 | 1/2004 | Krueger | |
| 2007/0017705 | A1 * | 1/2007 | Lasater | 175/61 |
| 2008/0035376 | A1 * | 2/2008 | Freyer | 175/45 |

* cited by examiner

*Primary Examiner* — Daniel P Stephenson
*Assistant Examiner* — James Sayre
(74) *Attorney, Agent, or Firm* — Cantor Colburn LLP

(57) ABSTRACT

An orientation measurement system is deployed in a wellbore drilling system having one or more reservoir imaging and characterization tools, directional tools, and/or other known BHA tools in a rotating section. The orientation measurement system includes a processor receiving signals from a rotary position sensor measuring an angular position of the rotating section relative to the non-rotating section and receiving signals from an orientation sensor determining the orientation of the non-rotating section relative to a reference frame such as highside. The processor uses the first and second signals to determine a tool face of the rotating member relative to the highside and periodically and/or continuously transmits the determined tool face along the BHA via a suitable communication link. The determined tool face is used by the BHA tools to synchronize measurements with highside and/or to determine azimuth.

18 Claims, 3 Drawing Sheets

INSTANTANEOUS MEASUREMENT OF DRILLSTRING ORIENTATION

CROSS REFERENCE TO RELATED APPLICATIONS

This application takes priority from U.S. Provisional Application Ser. No. 60/844,185 filed on Sep. 13, 2006.

BACKGROUND OF THE INVENTION

1. Field of the Invention

This invention relates generally to drilling assemblies that utilize an orientation sensing system.

2. Description of the Related Art

Valuable hydrocarbon deposits, such as those containing oil and gas, are often found in subterranean formations located thousands of feet below the surface of the Earth. To recover these hydrocarbon deposits, boreholes or wellbores are drilled by rotating a drill bit attached to a drilling assembly (also referred to herein as a "bottom hole assembly" or "BHA"). Such a drilling assembly is attached to the downhole end of a tubing or drill string made up of jointed rigid pipe or a flexible tubing coiled on a reel ("coiled tubing"). For directional drilling, the drilling assembly can use a steering unit to direct the drill bit along a desired wellbore trajectory.

Wellbore drilling systems can also use measurement-while-drilling (MWD) and logging-while-drilling (LWD) devices to determine wellbore parameters and operating conditions during drilling of a well. These parameters and conditions may include formation density, gamma radiation, resistivity, acoustic properties, porosity, and so forth. Many of these tools are directionally sensitive in that, to be meaningful, the measurements made by these tools should be correlated or indexed with a frame of reference for the formation. In one convention, the angular difference between a reference point on a tool and a frame of reference such as borehole highside or magnetic north is referred to as a toolface angle. As is conventionally understood, the term "borehole highside" is an uppermost side of a non-vertical borehole. It is commonly required to present the output from imaging sensors oriented with reference to the borehole highside. Conventionally, the methodology for determining a toolface of an imaging sensor involves the use of magnetic sensing devices because the shocks, vibrations, and centrifugal forces associated with a rotating system can unduly interfere with the operation of devices such as accelerometers that could provide a direct measurement of highside. The problems encountered with such conventional devices and methods include inaccurate or outdated conversions between magnetic toolface and highside, inaccuracy due to magnetic junk or hotspots, eddy currents induced in a rotating conductive collar, and errors caused by electric currents flowing in proximity to the sensor. In addition, while it is desirable to continuously measure the azimuth of the borehole while drilling, the value of such measurements has been limited due to the difficulty of accurately measuring transverse acceleration components of a rotating system.

The present invention is directed to addressing one or more of the above stated drawbacks for determining the orientation of logging tools and other components of a drilling system.

SUMMARY OF THE INVENTION

In one aspect, an orientation measurement system is deployed in a wellbore drilling system having at least one rotating section and one or more non-rotating sections. One or more reservoir imaging and characterization tools, directional tools, and/or other known bottomhole assembly (BHA) tools are positioned in the rotating section. The non-rotating section can include a non-rotating sleeve associated with a stabilizer or a steering unit. The orientation measurement system includes a processor, a rotary position sensor and an orientation sensor. The processor receives signals from the rotary position sensor, which measures an angular position of the rotating section relative to the non-rotating section. The processor also receives signals from the orientation sensor, which determines the orientation of the non-rotating section relative to a reference frame such as borehole highside. The processor uses the first and second signals to determine a tool face of the rotating member relative to the highside and periodically and/or continuously transmits the determined tool face along the BHA via a suitable communication link. The determined tool face is used by the BHA tools to synchronize measurements with highside and/or to determine borehole azimuth.

It should be understood that examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE PREFERRED EMBODIMENT

Figure 1:
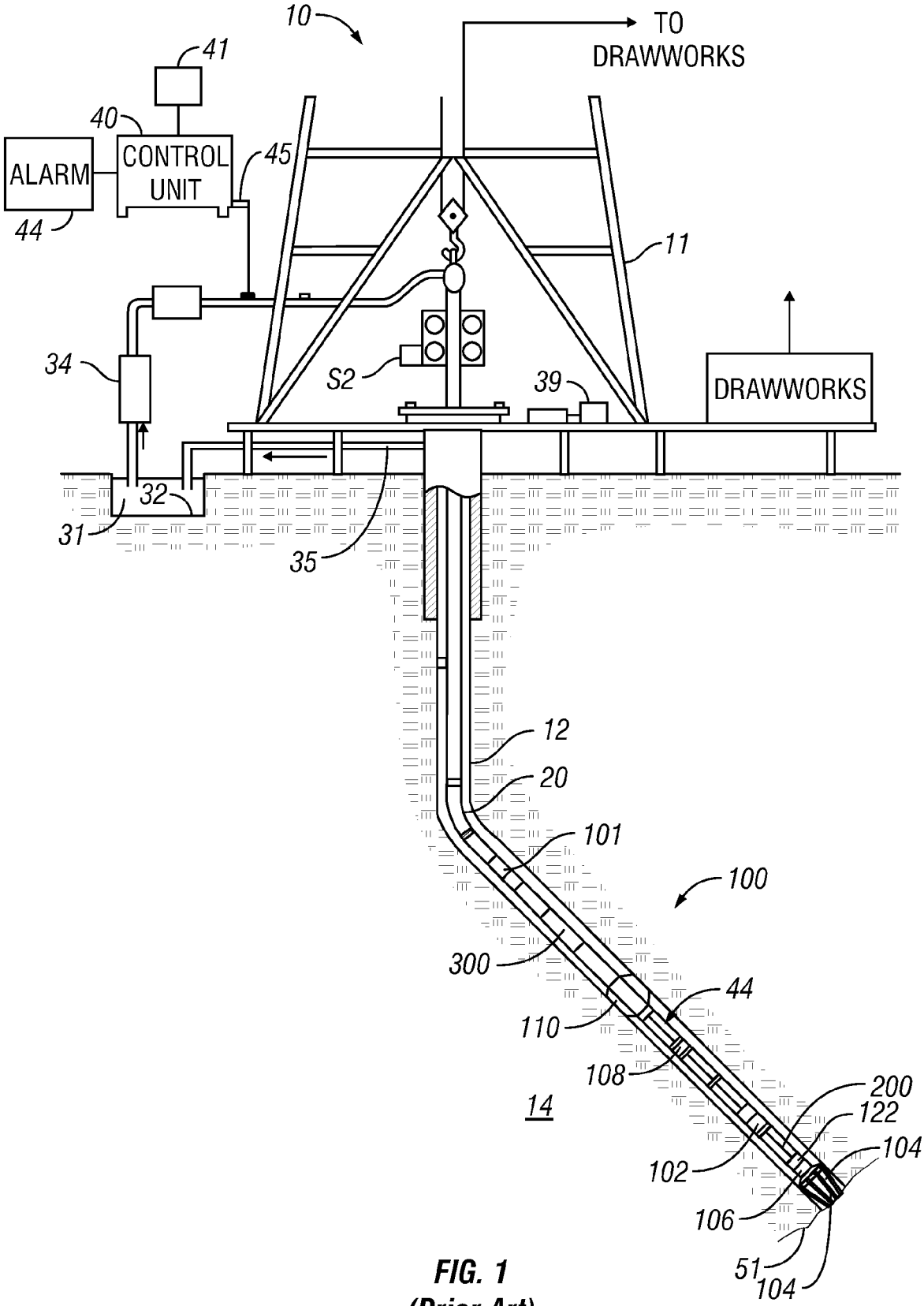
FIG. 1 (Prior Art)
FIG. 1 shows a schematic diagram of a drilling system with a bottom hole assembly according to one embodiment of the present invention.

The present invention relates to devices and methods providing orientation information for drilling system adapted to drill a wellbore in a subterranean formation. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1 there is shown a schematic diagram of a drilling system 10 having a bottom hole assembly (BHA) or drilling assembly 100 conveyed via a drill string 20 into a borehole 12 formed in a formation 14. The BHA 100 includes a drilling motor 102 for rotating a drill bit 104, a steering assembly 106 for steering the drill bit 104 in a selected direction, one or more BHA processors 108, one or more stabilizers 110, and other equipment known to those skilled in the art. The drill string 20 may include a tubing 101 formed of jointed drill pipe or coiled tubing. The drill string 20 may include one or more signal conductors that are configured to convey data signals and/or power along the drill string 20. The drill bit 104 may be rotated in any one of three modes: rotation by only the tubing 101, rotation by only the drilling motor 102, and rotation by a combined use of the tubing 101, and drilling motor 102. The BHA 100 also includes a logging tool 300, which may include a suite of tool modules, that obtain information relating to the geological, geophysical and/or petrophysical characteristics of the formation 14 being drilled.

Figure 2:
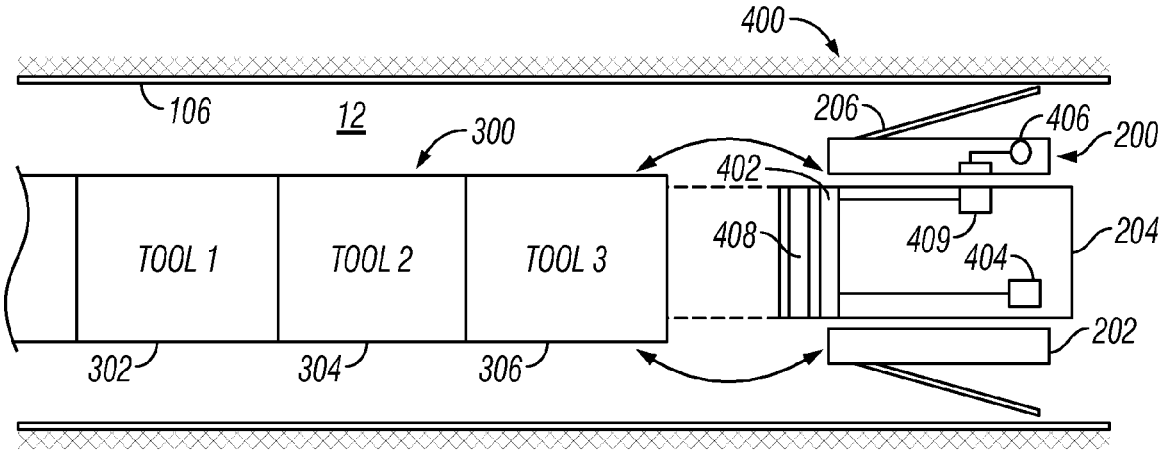
FIG. 2 shows a sectional schematic view of one orientation measurement system made in accordance with one embodiment of the present invention.

Referring now to FIG. 2, there are shown a section of a logging tool 300 and a steering unit 200. The logging tool 300, for illustrative purposes is shown as including three separate tool modules 302, 304, 306. These tool modules can measure parameters of interest such as gamma rays, resistivity, density, acoustic properties, and porosity. Other exemplary tools include radiation tools, tools for induction logs, ultra sonic caliper, and nuclear magnetic resonance tools (NMR). As is known, one or more of these tools can be directionally sensitive. That is, the direction the tool is pointing when taking a measurement must be known to make full use of the measurements. In one convention, the angular position of the tool relative to a reference frame, such as borehole highside, is defined as a "tool face" of the tool module 302. For example, using the sensor's sensitive axis as the reference point, the measurements of the tool module 302 can be correlated with a selected formation reference point such as borehole "highside," e.g., a measurement's tool face can be reported as 90 degrees from highside. In embodiments where the tool modules 302, 304, 306 are positioned on a rotating section of the drill string 20 (FIG. 1), the tool face of the tool module 302 rotates relative to the borehole highside. Thus, it is desirable to periodically and/or continuously determine the tool face of the tool module 302 relative to highside or other selected reference frame while the tool module 302 is making measurements.

Accordingly, embodiments of the BHA 100 include an orientation measurement system 400 that determines the orientation of a selected reference point on the rotating portion 204 of the drill string 20 (FIG. 1) relative to a highside or other selected reference frame. In one configuration, the orientation is expressed as an angular value between the selected reference point and highside. This angular value will be referred to as the "tool face." This determined tool face can be used by tool modules 302, 304, 306 to correlate their measurements with "borehole highside."

An exemplary orientation measurement system 400 is used in conjunction with the device 200 having a non-rotating section 202 and a rotating section 204. The logging tool 300 is coupled to and rotates with the rotating section 204. The orientation measurement system 400 includes a processor 402 that receives a first signal from a rotary position sensor 404 that determines the angular position of the rotating section 204 relative to the non-rotating section 202 and receives a second signal from an orientation sensor 406 that determines the orientation of the non-rotating section 202 relative to a reference frame such as highside. The processor 402 is programmed with instructions to use the first and second signals to determine a tool face of the rotating member 204 relative to the borehole highside. The processor 402 periodically and/or continuously transmits the determined tool face along the BHA 100 via a communication link 408. The determined tool face can be used by the tool 300 to immediately correlate measurements or can be saved in a memory for correlation of the data at a later time. The determined tool face data can also be transmitted to the surface.

In one arrangement, the device 200 can be a BHA steering assembly wherein the non-rotating member 202 is a non-rotating sleeve and the rotating member 204 is a mandrel. The steering assembly also includes a plurality of force application members 206 that selectively engage the borehole wall 106 of the wellbore 12 to thereby lock or anchor the non-rotating sleeve 202 to the wall 106. The non-rotating sleeve 202 might slightly rotate due to the frictional forces between the non-rotating sleeve 202 and a rotating mandrel 204 on which the non-rotating sleeve 202 is mounted. It should be understood, however, that the present invention is not limited to use of a steering assembly. Other suitable devices can include a drill string stabilizer 110 (FIG. 1) having a non-rotating sleeve or other similar device having a rotating and non-rotating component.

The orientation sensor 406 can be positioned on the non-rotating sleeve 202 to determine the orientation of the non-rotating sleeve 202 relative to a selected reference frame and transmit a responsive signal. Typically, the reference frame is borehole highside, but it can be magnetic north or some other selected frame of reference. For example, the orientation sensor 406 can include a multi-axis accelerometer that transmits a signal indicative of the orientation of the non-rotating sleeve relative to highside; i.e., the tool face of the non-rotating sleeve 202. The data from the orientation sensor 406 can be transmitted via a suitable coupling 409 (e.g., electrical slip rings, RF signals or inductive coupling) from the non-rotating sleeve 202 to the rotating mandrel 204. The processor 402 is operatively coupled to and receives data from the orientation sensor 406 via the coupling 409.

An exemplary rotary position sensor 404 transmits a signal indicative of the orientation of the rotating member 204, such as a mandrel, relative to the non-rotating section 202, such as the non-rotating sleeve. In one embodiment, the rotary position sensor 404 is configured to transmit a signal when a specified orientation exists between the non-rotating member 202 and the rotating member 204. For instance, the rotary position sensor 404 can transmit a signal when the non-rotating member 202 and the rotating member 204 are aligned, which then means that the tool face angles for both devices are the same. This type of arrangement may be useful for directional surveys wherein drilling motions limit the accuracy of the toolface sensors in the directional module. In another embodiment, the rotary position sensor 404 continually transmits a signal indicative of the orientation of the rotating member 204 relative to the non-rotating sleeve 202. Under this continuous or instantaneous signal transmission scenario, the tool face angle is continuously determined and transmitted across the BHA 100, including the logging tool 300. Therefore, the logging tool 300, with its constituent modules, can continuously synchronize their measurements with the determined tool face angle.

Figure 3:
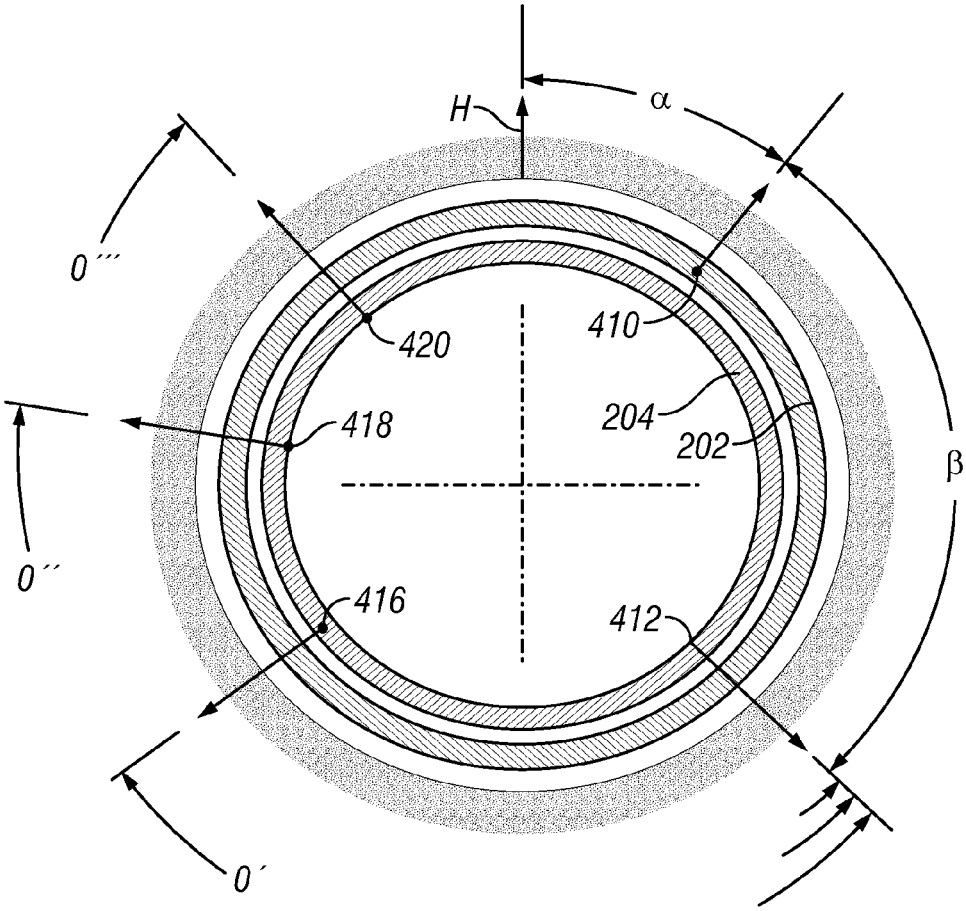
FIG. 3 illustrates the relationships of the measured angular offsets in accordance with one embodiment of the present invention.

Referring now to FIGS. 2 and 3, in one mode of operation, the orientation sensor 406 determines the orientation of a reference point 410 on the non-rotating sleeve 202 relative to the highside H of the wellbore and transmits a signal indicative of this orientation to the processor 402. At the same time, the rotary position sensor 404 determines the tool face of a reference point 412 on the rotating mandrel 204 relative to a reference point 410 on the non-rotating sleeve 202 and transmits an indicative signal to the processor 402. The processor 402 sums the two angles to determine a tool face angle of the rotating mandrel relative to the highside H. For illustrative purposes, a reference point 410 on the non-rotating sleeve 202 is shown as having a tool face of $\alpha$ degrees from the highside H of the wellbore and the reference point 412 on the mandrel is shown as having a tool face of $\beta$ degrees from the reference point 410. Thus, the tool face angle of the rotating mandrel relative to the highside H is $\alpha+\beta$.

The processor 402 transmits the determined tool face (a+13) along the BHA 100 via the communication link 408. The communication link can utilize wires such as electrical conductors or fiber optics, wired pipe, magnetic signals, acoustic signals, pressure pulses, RF transmission or any other suitable signal transmission media. When the tool modules 302, 304, 306 receive the tool face angle, an additional calculation may have to be performed to determine the tool face angle of each of these tool modules 302, 304 and 306 relative to highside H. As is known, each tool module 302, 304 and 306 can have a separate reference point 416, 418, 420, respectively, that is rotationally offset relative to the reference point 412 of the mandrel by angles θ', θ", θ'", respectively. These offsets 416, 418, 420 are determined at the time the BHA 100 is made up or can be determined downhole when the tool modules 302, 304, 306 are not rotating. Determination of the tool face angles for reference points 416, 418, 420, relative to highside H, therefore, will require adding the angles θ', θ", and θ'", to the summation ($\alpha+\beta$), respectively. This correction can be performed using the processor 402, a suitable processor in the tool 300 or at the surface. Thereafter, the data acquired by the modules 302, 304 and 306 can be readily oriented with the highside H of the wellbore.

Additionally, at one of the modules 302, 304 or 306, the tool face angle data can be used to calculate azimuth while rotating. Azimuth is the angle between the horizontal component of a borehole direction at a particular point and the direction of north. The angle can be expressed in the 0-360 degree system. The angle may refer to either magnetic, true (geographic), or grid north. One known method for determining magnetic azimuth A in the static case uses the following equation:

$$A=a\tan[\{G\cdot(B_y\cdot G_x-B_x\cdot G_y)\}/\{B_z\cdot(G_x^2+G_y^2)-G_z\cdot(B_x\cdot G_x+B_y\cdot G_y)\}] \quad (1)$$

Where G (acceleration due to gravity)=$\sqrt{(G_x^2+G_y^2+G_z^2)}$. In accordance with one embodiment of the present invention, azimuth is calculated using the following equation:

$$A=a\tan[\{B_{xy}\cdot\sin(M-T)\}/\{B_z\cdot\sin/+B_{xy}\cdot\cos/\cdot\cos(M-T)\}] \quad (2)$$

where $B_{xy}=\sqrt{(B_x^2+B_y^2)}$, M (magnetic toolface)=$\tan^{-1}(B_x/B_y)$, and T (highside toolface)=$\tan^{-1}[(-Gx)/(-Gy)]$.

The above equation, which should be understood as merely illustrative, determines the toolface offset (M−T) using: (i) the tool face data indicative of gravity toolface at non-rotating sleeve, (ii) magnetic tool face at the module as determined by a suitable sensor, and (iii) a sleeve-to-mandrel relative rotary position measured directly by one of several methods which are generally known. One or more processors at the modules 302, 304, 306 can be programmed to calculate azimuth. The processors can include appropriate instructions to synchronize magnetic data at the modules 302, 304, 306 with the tool face data. While Gz may be obtained from either node, it is preferred from the directional node since this sensor is better aligned with the Bz sensor.

The processor at the tool 300 can also compensate for eddy current effects that tend to bias measured magnetic measurements while rotating. Exemplary compensation techniques are described in U.S. Pat. No. 5,012,412, which is hereby incorporated by reference for all purposes. In embodiments, where the sleeve-to-mandrel angle is measured magnetically, the need for compensation may be reduced because the M and the sleeve-to-mandrel angle could be biased similarly. In calculating instantaneous azimuth, it will be particularly important to account for delays in transmission of toolface between nodes, and also to compensate for eddy currents which affect the transverse magnetometer measurements.

It is believed that torsional acceleration can affect the above computations in extreme operating conditions, such as during reverse rotation of the drill bit. Sensors suitable to accurately measure tool face during such conditions should measure the non-rotating sleeve-to-rotating member angle directly, not just by inferential methods, e.g., counting events from a reference mark.

Any number of arrangements can be utilized for the rotary position sensor 400. The arrangements can be configured to meet a specified application. A few illustrative embodiments are discussed below.

Figure 4:
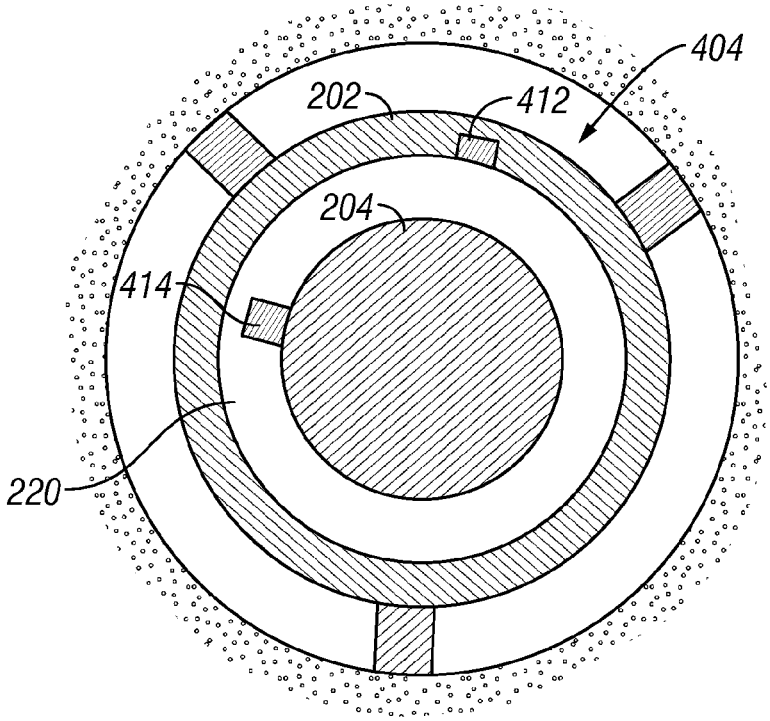
FIG. 4 sectional schematic view of one rotary position sensor made in accordance with one embodiment of the present invention.

Referring now to FIG. 4, in one embodiment, a rotary position sensor 404 includes a first member or element 412 positioned on the non-rotating sleeve 202, and a second member or element 414 positioned on the rotating member 204. This first member 412 is positioned at a fixed relationship with respect to a selected reference point on the non-rotating member 202. The second member 414 either actively or passively detects the first member 412. These position signals can be generated, for example, when the first member 412 is proximate to the second member 414 or in a specified relationship with each other. In another arrangement, a position signal can be emitted when the first member 412 is not proximate to the second member 414. For example, the first member 412 can actively emit a signal such as an electrical signal, a magnetic signal, or an acoustic signal. In a passive arrangement, the first member 412 can be a discontinuity that is actively detected by the second member 414. In other arrangements, the first member 412 can be positioned on the rotating member 204 and the second member can be positioned on the non-rotating member 202. It will be apparent to one of ordinary skill in the art that other arrangements may be used in lieu of magnetic signals. Such other arrangements for detecting orientation include inductive transducers (linear variable differential transformers), coil or hall sensors, and capacity sensors. Still other arrangements can use radio waves, electrical signals, acoustic signals, optical signals, and interfering physical contact between the first and second members.

Figure 5:
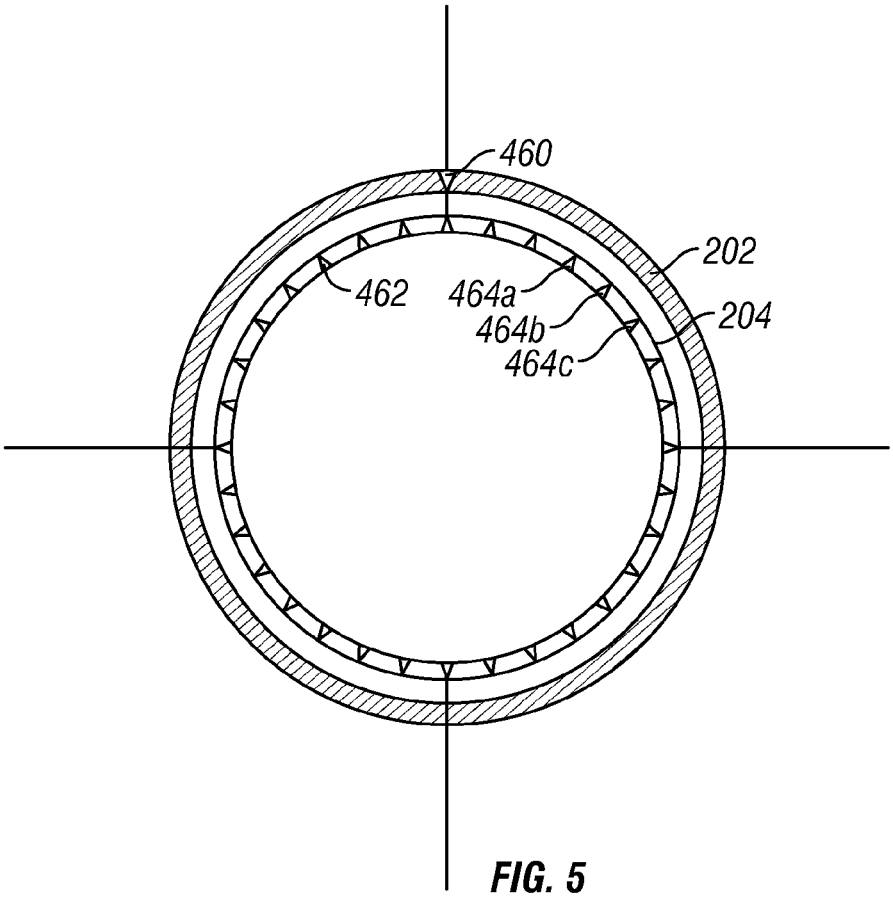
FIG. 5 sectional schematic view of another rotary position sensor made in accordance with one embodiment of the present invention.

Referring now to FIG. 5, in another embodiment, the non-rotating sleeve 202 can include one or more position markers such as a discontinuity, e.g., a projection or depression 460. One or more Hall effect type sensors 462 or other suitable sensors on the rotating mandrel 204 detects the position marker(s) and sends a responsive signal to the processor. In one arrangement, the discontinuity can be a missing tooth or an extra tooth at a pre-determined position. The sensor 462 can be configured to detect the gap or the extra projection. In another arrangement, the sensor 462 is configured to precisely determine the angular relationship of the non-rotating sleeve 202 and the rotating mandrel 204 at any time. In embodiments utilizing a plurality of sensors, the sensors 464*a-c* can be circumferentially arrayed around the mandrel 204 to determine angular relationship at any time and to positively identify the direction of rotation. With multiple sensors, the progression of the detection of the sensors can be monitored. Any non-sequential detection by the sensors, can indicate a backward rotation of the drill string. While the sensors are shown on the rotating mandrel, in certain arrangements the sensors can be positioned on the non-rotating sleeve and the discontinuity or position marker formed on the rotating mandrel.

Referring now to FIG. 1, embodiments of the present invention can be utilized with the drilling system 10 adapted for either land or offshore drilling. For land based drilling, the drilling system 10 includes a conventional derrick 11. The drill string 20, which includes a tubing (drill pipe or coiled-tubing) 101, extends downward from the surface into the borehole 12. A tubing injector 14*a* is used to inject the BHA 100 into the wellbore 12 when a coiled-tubing is used. The drill bit 104 attached to the drill string 20 disintegrates the geological formations when it is rotated to drill the borehole 12. During drilling, a suitable drilling fluid 31 from a mud pit (source) 32 is circulated under pressure through the drill string 20 by a mud pump 34. The drilling fluid 31 discharges at the borehole bottom 51 through openings in the drill bit 104 and returns to the mud pit 32 via a return line 35.

The drilling system also includes a bi-directional communication link 39 and surface sensors, collectively referred to with $S_2$. The communication link 39 enables two-way communication between the surface and the drilling assembly 100. The communication link 39 may be mud pulse telemetry, acoustic telemetry, electromagnetic telemetry or other suitable communication system. The surface sensors $S_2$ include sensors that provide information relating to surface system parameters such as fluid flow rate, torque and the rotational speed of the drill string 20, tubing injection speed, and hook load of the drill string 20. The surface sensors $S_2$ are suitably positioned on surface equipment to detect such information. These sensors generate signals representative of its corresponding parameter, which signals are transmitted to a processor by hard wire, magnetic or acoustic coupling. The sensors generally described above are known in the art and therefore are not described in further detail.

The drilling system 10 includes surface and/or downhole processors to control BHA 100 operation. In one embodiment, the drilling system 10 includes a control unit 40 and one or more BHA processors 44 that cooperate to analyze sensor data and execute programmed instructions to achieve more effective drilling of the wellbore. The control unit 40 and BHA processor 44 receives signals from one or more sensors and process such signals according to programmed instructions provided to each of the respective processors. The surface control unit 40 displays desired drilling parameters and other information on a display/monitor 41 that is utilized by an operator to control the drilling operations. Each processor 40,44 contains a computer, memory for storing data, recorder for recording data and other known peripherals.

During operation, the drill bit forms the wellbore by disintegrating the formation and thereby advancing the drill string there through. At the same time, the logging tool 300 is measuring various parameter of interest relating to the formation being intersected by the wellbore. When desired, the orientation measurement system 400 (FIG. 2) determines the tool face of the rotating mandrel relative to borehole highside and transmits or broadcasts the determined tool face to the several components making up the BHA 100. The logging tool 300 receives the tool face and uses this information to correlate measurements to highside. A continuously broadcast determined tool face angle is used by tools such as reservoir imaging and characterization tools. A continuously or periodically broadcast determined tool face angle can be used by directional tools to calculate azimuth as needed. Of course, other components in the BHA 100, e.g., the steering unit, can also utilize such orientation data.

In some embodiments, the output of the orientation measurement system 400 (FIG. 2) is correlated with the measurements of the logging tool 300 downhole. That is, for example, azimuthal information can be correlated with the logging tool measurements downhole while drilling is on-going. In such an arrangement, the logging tool measurements are immediately associated with and orientation measurement. In other embodiments, the output of the orientation measurement system 400 (FIG. 1) may be associated with a separate reference such as time. Likewise, the logging tool measurements may be stored and associated the same reference. Thus, at a later point, while downhole or at the surface, the logging tool measurements and the orientation measurements may be correlated using the common reference.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. An apparatus for determining a rotational position of a reference point relative to a reference frame and drilling a wellbore using a drill string having a rotating member and a non-rotating member, comprising:

a sensor; and an orientation measurement system positioned on the drill string, the orientation system being configured to determine, during drilling of the wellbore, a rotational position of a first reference point on the rotating member relative to a highside of the wellbore using a determined rotational position of the first reference point on the rotating member relative to a second reference point on the non-rotating member and a measured rotational position of the second reference point relative to the highside of the wellbore, wherein the measured rotational position of the second reference point relative to the highside of the wellbore is measured using the sensor.

2. The apparatus of claim 1 further comprising an orientation sensor positioned on the non-rotating member and configured to provide a signal indicative of the rotational position of the second reference point on the non-rotating member relative to the highside of the wellbore.

3. The apparatus of claim 2 wherein the orientation sensor includes at least one accelerometer.

4. The apparatus of claim 1 wherein the orientation measurement system includes a processor programmed to determine the rotational position of the first reference point on the rotating member relative to the highside of the wellbore using a first signal indicative of the rotational position of the non-rotating member to the highside of the wellbore and a second signal indicative of the rotational position of the rotating member relative to the non-rotating member.

5. The apparatus of claim 4 wherein the processor is further programmed to transmit the determined rotational position along at least a portion of the drill string.

6. The apparatus of claim 5 further comprising a communication link operatively connected to the processor.

7. The apparatus of claim 1 further comprising at least one directionally sensitive measurement tool coupled to the rotating member.

8. The apparatus of claim 7 further comprising a processor configured to correlate a measurement of the at least one directionally sensitive measurement tool with a determined rotational position of the rotating member relative to the highside of the wellbore.

9. The apparatus of claim 1 wherein the rotational position includes one of: (i) azimuth, (ii) a position relative to magnetic north, and (iii) a position relative to a direction of gravitational force.

10. A method of determining a rotational position of a reference point relative to a reference frame and drilling a wellbore in a subterranean formation, comprising:

(a) forming the wellbore using a drill string having a rotating section and a non-rotating sleeve surrounding the rotating section; and (b) determining a rotational position of a first reference point on the rotating section relative to a highside of the wellbore using a determined rotational position of the first reference point on the rotating member relative to a second reference point on the non-rotating member and a measured rotational position of the second reference point relative to the highside of the wellbore using an orientation measurement system during drilling of the wellbore, wherein the measured rotational position of the second reference point relative to the highside of the wellbore is measured using a sensor.

11. The method of claim 10 further comprising determining the rotational position of the second reference point on the non-rotating member with an orientation sensor.

12. The method of claim 11 further comprising determining the rotational position of the first reference point on the rotating member relative to the second reference point on the non-rotating member with a rotary position sensor positioned on the rotating member.

13. The method of claim 10 further comprising operating a directionally sensitive tool to measure a parameter of interest relating to the formation, wherein the directionally sensitive measurement tool is connected to the rotating member.

14. The method of claim 13 further comprising correlating a determined rotational position of the first reference point on the rotating member with a measurement of the directionally sensitive tool.

15. The method of claim 10 further comprising transmitting a determined rotational position along at least a section of the drill string.

16. The method of claim 15 further comprising receiving the transmitted determined rotational position and correlating the determined rotational position with a measurement of the at least one directionally sensitive measurement tool positioned along the drill string.

17. A system for determining a rotational position of a reference point relative to a reference frame and drilling a wellbore, comprising:

(a) a drill string having a rotating section;

(b) a non-rotating member surrounding a portion of the rotating section;

(c) an orientation sensor positioned on the non-rotating member, the orientation sensor providing a signal indicative of a measurement of a rotational position of a reference point on the non-rotating member, during drilling of the wellbore, relative to a highside of the wellbore;

(d) at least one directionally sensitive measurement tool positioned on the rotating section; and (e) an orientation measurement system positioned on the drill string, the orientation system being configured to determine a rotational position of the at least one directionally sensitive measurement tool using the signal provided by the orientation sensor and a measured rotational position of the second reference point relative to the highside of the wellbore.

18. The system of claim 17 further comprising a processor configured to determine a rotational position of a reference point on the rotating member and transmit the determined rotational position along at least a portion of the drill string.

* * * * *